United States Patent [19]

Brack

[11] 3,949,921

[45] Apr. 13, 1976

[54] FASTENING GUN

[75] Inventor: Jacques Brack, Nyon, Switzerland

[73] Assignee: Olin Ski A.G., Oberhunenberg, Switzerland

[22] Filed: July 30, 1974

[21] Appl. No.: 493,641

[30] Foreign Application Priority Data

July 9, 1973 Switzerland ..... 11523/73

[52] U.S. Cl. ..... 227/9

[51] Int. Cl.[2] ..... B25C 1/18

[58] Field of Search ..... 227/8, 9, 10, 11

[56] References Cited

UNITED STATES PATENTS

| | | | |
|---|---|---|---|
| 2,669,716 | 2/1954 | Catlin | 227/8 |
| 2,804,620 | 9/1957 | Gannon | 227/9 |
| 3,168,744 | 2/1965 | Kvaule | 227/10 X |
| 3,255,942 | 6/1966 | Bell et al. | 227/8 |

*Primary Examiner*—Granville Y. Custer, Jr.
*Attorney, Agent, or Firm*—Holman & Stern

[57] ABSTRACT

A fastening gun of the type in which a striker causes the ignition of a charge. A locking member, moveable in a direction transverse to the direction of movement of the striker assembly is provided which is engaged by the striker assembly when the locking member is in its locking position. A trigger member is provided remote from the locking member. An elongated rod member is attached to and extends from the trigger member toward the locking member. Ramp means are provided including an inclined surface which cooperates with the free end of the elongated rod member to raise either the rod member or the ramp means to engage the locking member and move it from its locking position to its unlocking position upon actuation of the trigger.

4 Claims, 13 Drawing Figures

FASTENING GUN

The invention relates to a fastening gun of the type in which a striker ignites a charge which drives in a sealing plug, usually through the medium of a piston.

In guns of this type, the striker is integral with a hammer which furnishes the kinetic energy for driving the striker and the assembly is urged toward the charge by a spring termed the striker spring. The striker-hammer assembly is maintained in the position for compressing the striker spring by a bolt which is released by the operator usually by means of a trigger.

Guns of the foregoing type are in particular known in which the bolt of the striker-hammer assembly is constituted by a locking member which has a center bore through which the striker and the hammer are slidable and which is movable in a plane perpendicular to the axis of the striker so as to permit or prevent the sliding of the striker, the locking member co-operating with a shoulder of the striker-hammer assembly so as to stop the latter. The locking member is biased elastically to the locking position and is shifted in the opposite direction for unlocking the striker. This movement of the locking member is generally achieved by the rotation of a trigger whose heel portion bears directly, or through the medium of another member, on the locking member.

It is difficult to apply this known device to a gun in which the front of the grip is remote from the bolt of the striker, since the lever arms required result in insufficient sensitivity or in an excessive travel of the detent with in any case large overall size.

An object of the invention is to overcome these drawbacks.

These advantages and others will be apparent from the ensuing description.

According to the invention, the detent of the gun is integral with a rod whose end, in the course of the translation of the trigger, co-operates with an inclined ramp to cause the unlocking of the locking member.

In this way, if the operator prematurely depresses the trigger during the application of the gun, the travel of the moving part is limited and this prevents an untimely firing.

The invention is of particular advantage in the case of a gun having a case-less munition of the type in which a part of the gases of combustion is admitted to the rear of the striker, the invention providing in this case an arrangement in which the rod slides in a recess employed for the evacuation of this part of the gases of combustion.

An understanding of the invention will be had from the ensuing description with reference to the accompanying drawing in which.

Figure 1:
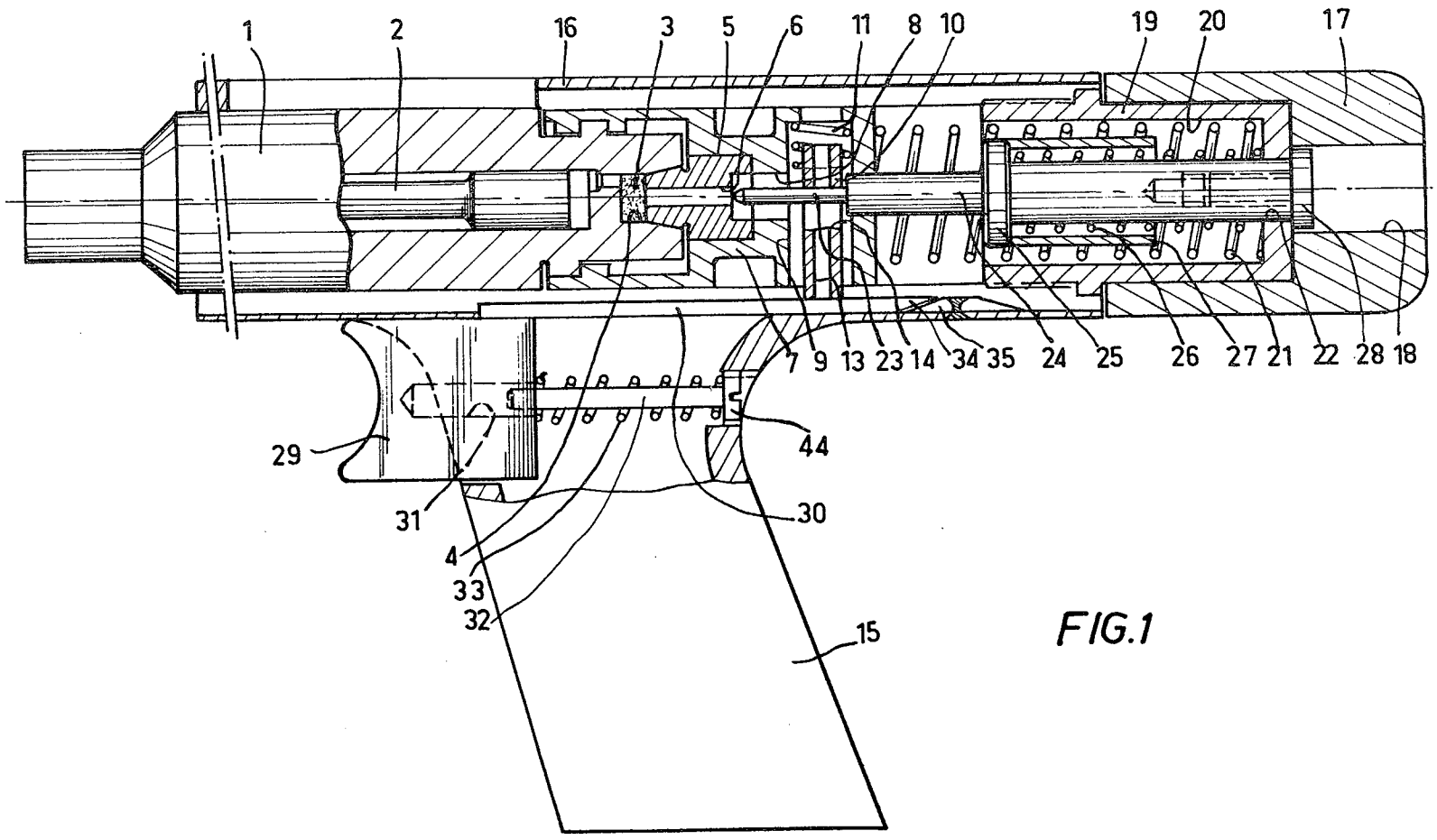
FIG. 1 is a longitudinal sectional view of one embodiment of a gun according to the invention before arming.
Figure 4:
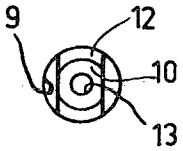
FIG. 4 is a plan view of the locking member.

Reference will be made first to FIG. 1. The gun comprises a barrel 1 in which a piston 2 is slidable, this piston being shifted by the gases of combustion of a caseless munition 3 disposed in a bore 4 formed between the barrel and a closure member 5 which is provided with a bore 6 whose axis is parallel to the barrel and which is rendered integral with the barrel 1 by a breech 7 fixed to the barrel and provided with a bore 8 which is coaxial with the bore 6 but of larger diameter. The breech 7 is also provided with a bore 9 perpendicular to the bore 8. A locking member 10 is slidable in the bore 9 perpendicular to the axis of the barrel 1 and is biased downwardly by a coil spring 11 which bears against the upper end of the bore 9 against a shoulder 12 (FIG. 4) formed in the upper part of the locking member 10. The locking member 10 is provided with a longitudinal bore 12 which is also perpendicular to the axis of the barrel 1 and a throughway aperture 14 whose section is substantially equal to that of the bore 8 of the breech 7.

The assembly just described is movable in a direction parallel to the axis of the barrel with respect to the grip 15 of the gun which has a bored portion 16 in which are slidable the barrel 1 and the parts integral therewith, the bore of the portion 16 of the barrel being closed by a member 17 provided with a bore 18 parallel to the axis of the barrel. A rear plug 19 is disposed between the portion 16 of the grip and the member 17. The plug 19 has a cavity 20 open at the front end, a compression spring 21 being disposed between the rear of the breech 7 and the end of the cavity 20 and biasing the assembly integral with the barrel 1 forwardly. The end of the cavity 20 is provided with a bore 22 which is coaxial with the bore 18 but of smaller diameter.

Disposed between the barrel 1 and the grip 15 is a striker system comprising a striker pin 23 co-operating with the bore 6 and a hammer 24 whose section is less than the sections of the bore 8 and aperture 14. The hammer 24 is provided with a flange on the rear of which bears one end of a striker spring 26 whose other end bears against the end of the cavity 20. A spacer member 27 limits the displacement of the striker assembly 23–24 by its abutment with the end of the cavity 20. The forward travel of the striker assembly 23–24 is limited by a stop 28 which bears against the rear of the rear plug 19, the rear of the hammer 24 being capable of sliding in the bore 22 whereas the stop 28 is slidable in the bore 18.

The grip 15 carries a trigger 29 which is integral with a rod 30 substantially parallel to the axis of the gun. The trigger 29 carries a blind bore 31 parallel to the axis of the gun and co-operating with a guide rod 32 fixed to the grip 15, a trigger spring 33 bearing against the rear of the trigger 29 and against a head 44 integral with the rod 32 which is capable of being inserted to a variable extent in the grip 15 to adjust the pre-compression of the trigger spring 33. The bore 31 has a diameter slightly greater than that of the guide rod 32 so as to allow a slight tilting of the trigger 29 and therefore of the rod 30 which is integral therewith.

Figure 8:
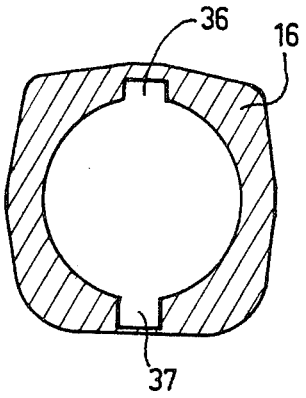
FIG. 8 is a sectional view of the grip of the gun.
Figure 7:
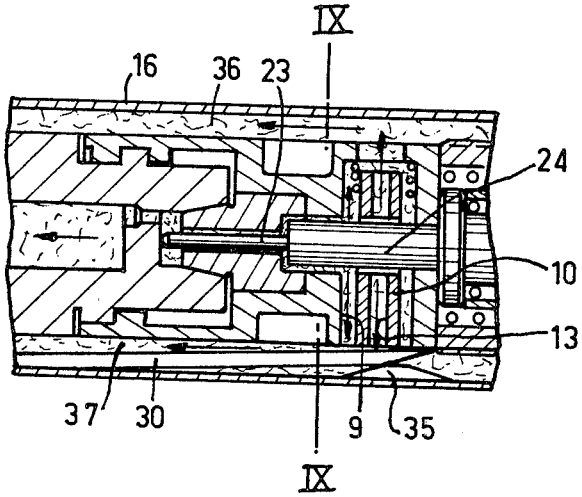
FIG. 7 is a view of a part of the gun in the position shown in FIG. 5 and shows the path of the gases of combustion.

The rear end of the rod 30 has a bevel 34 facing a ramp 35 integral with the bore of the portion 16 of the grip 15. The rod 30 extends under the locking member 10 which is biased towards the rod 30 by the spring 11. The bored portion 16 of the grip 15 has two diametrically opposed grooves 36 and 37 (FIG. 8), the lower groove 37 acting as a guide for the rod 30.

In the position of rest shown in FIG. 1, the spring 21 moves the barrel 1 away from the grip, the movement of the assembly integral with the barrel being limited by a stop (not shown). The striker spring 26 urges the striker assembly 23–24 forwardly, the stop 28 limiting its movement. The striker pin 23 is engaged in the aperture 14 which is eccentric with respect to the striker pin 23 owing to the fact that the locking member 10 is in its lower position.

Figure 2:
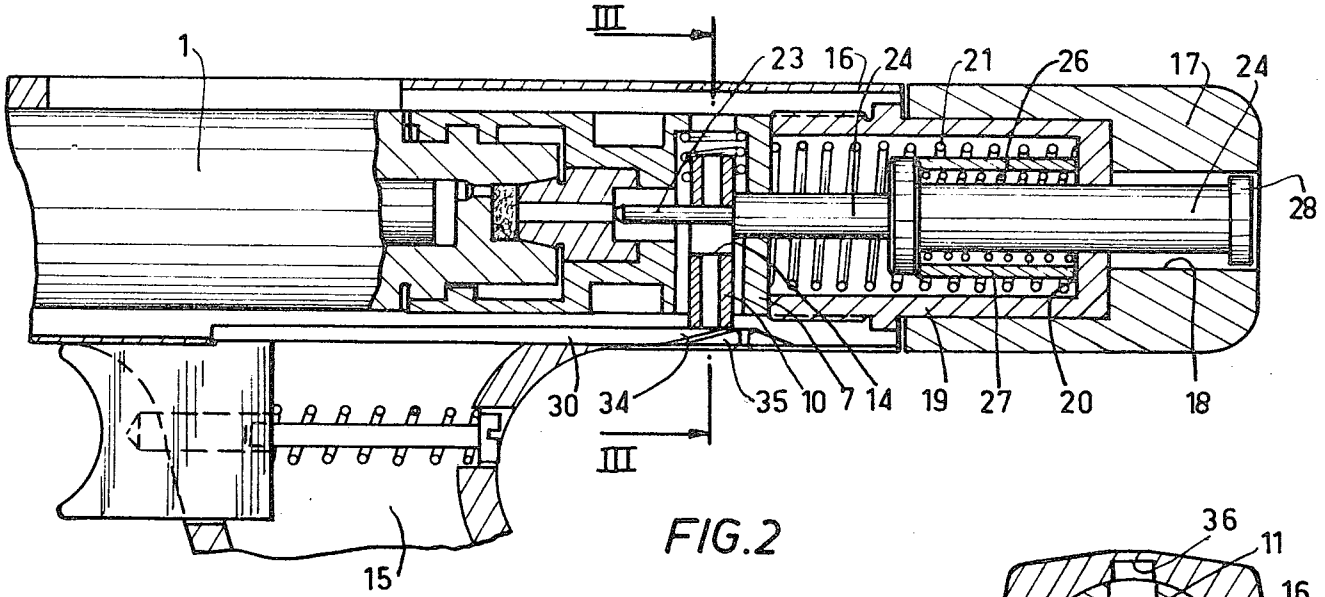
FIG. 2 is a similar view of a part of the gun shown in FIG. 1, this gun being held against the object into which a plug is to be driven.
Figure 3:
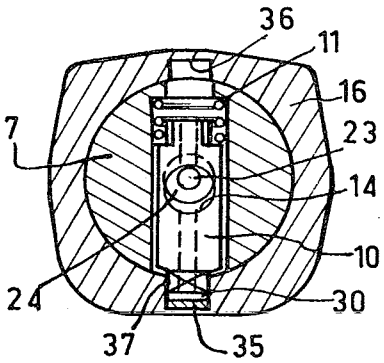
FIG. 3 is a sectional view taken on line III—III of FIG. 2.

When the barrel 1 of the gun is made to bear against a wall (FIG. 2), the operator gripping the grip 15, the assembly integral with the barrel 1 moves with respect to the grip 15 and compresses the spring 21. At the beginning of this movement, the locking member 10 reaches the level of the shoulder between the striker pin 23 and the hammer 24 and bears against this shoulder (FIG. 3) owing to the fact that the aperture 14 is not aligned with the hammer 24. The assembly integral with the barrel 1 therefore shifts the striker assembly and compresses the striker spring 26 until the rear of the breech 7 abuts the front end of the plug 19, the rear of the hammer 24 and the stop 28 having moved along the bore 18.

The length of the rod 30 is such that its end is then under the locking member 10, the bevel 34 and the ramp 35 being substantially below the member 10. The gun is ready for firing, the compression of the spring 21 corresponding to the required prescribed charge and the striker spring 26 being compressed to within the neighbourhood of its maximum compression by the fact that the rear end of the spacer member 27 is in the vicinity of the end of the cavity 20.

Figure 5:
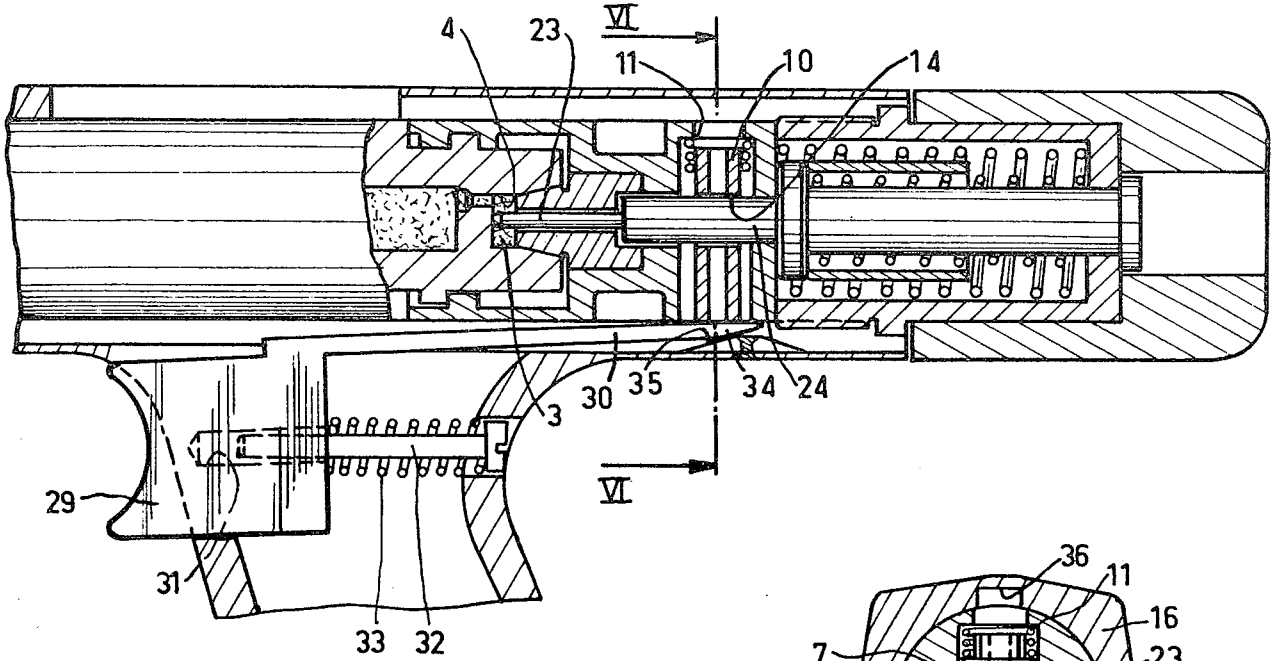
FIG. 5 is a view similar to FIG. 3, after firing.
Figure 6:
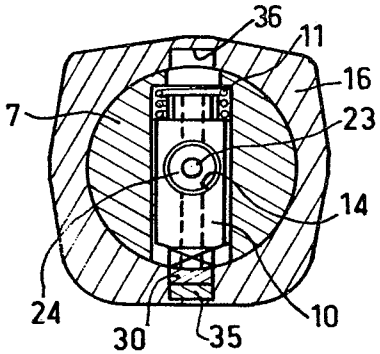
FIG. 6 is a sectional view taken on line VI—VI of FIG. 5.

If, in this position, the operator shifts the trigger 29 rearwardly against the action of the spring 33, the rod 30 moves rearwardly and is raised owing to the cooperation of its bevel 34 with the ramp 35. This raising of the rod 30 causes a slight rotation of the trigger 29 which is rendered possible by the clearance between the guide rod 32 and the bore 31. This raising of the rod 30 causes a raising of the locking member 10 against the action of the spring 11 and brings the aperture 14 to a position in which it is substantially coaxial with the hammer 24 (FIG. 6). The striker assembly is no longer retained by the locking member 10 and is thrown forwardly by the extension of the striker spring 26 (FIG. 5). The point of the striker pin 23 arrives in the vicinity of the front end of the cavity 4 and ignites the charge 3.

Figure 9:
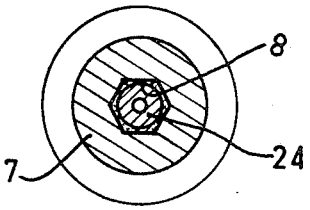
FIG. 9 is a sectional view taken on line IX—IX of FIG. 7.

In the illustrated embodiment (FIG. 9), the bore 8 in which the hammer 24 slides has a hexagonal section which allows the gases of combustion, coming from the clearance between the striker pin 23 and the bore 6, to escape to the rear of the hammer 24 so that there is no tendency to urge the striker assembly rearwardly. These gases reach, by way of the center bore 13 of the locking member 10 and the clearance between this member 10 and the wall of the bore 9, the grooves 36 and 37 of the portion 16 of the grip (FIG. 8) whence they are discharged to the exterior of the gun and into the grip 15.

Figure 10:
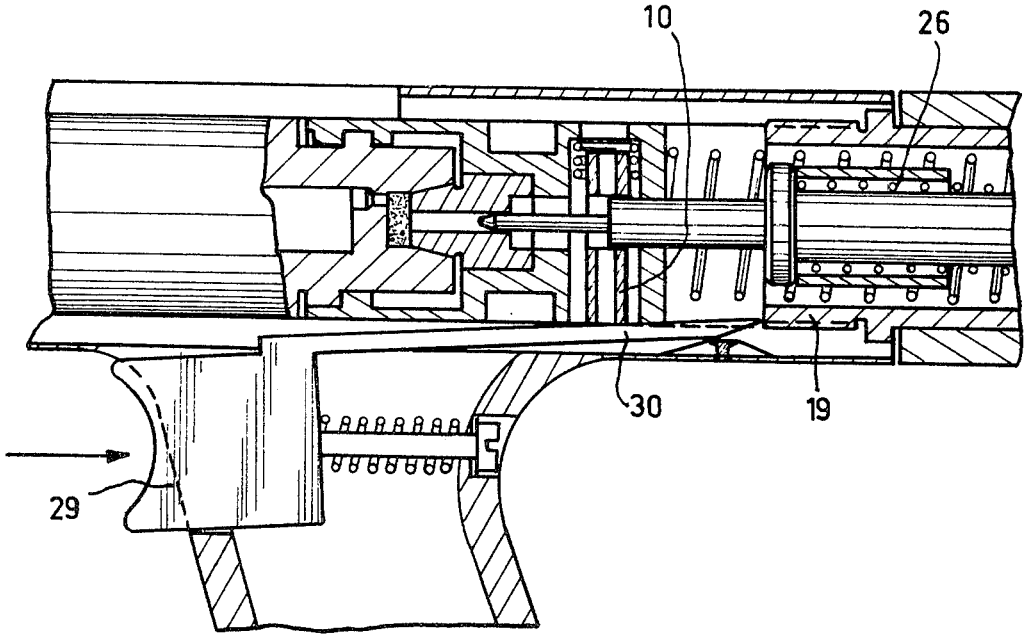
FIG. 10 is a view similar to FIG. 5, the trigger being depressed in the course of urging the gun against the object.

If the operator accidentally depresses the trigger 29 while the gun is being urged against the wall (FIG. 10), the rear end of the rod 30 bears against the front end if the plug 19 and the locking member 10 is raised. This prevents the arming of the striker spring 26 and, moreover, the breech is prevented from continuing to move rearwardly by the fact that it jams against the rod 30.

Figure 11:
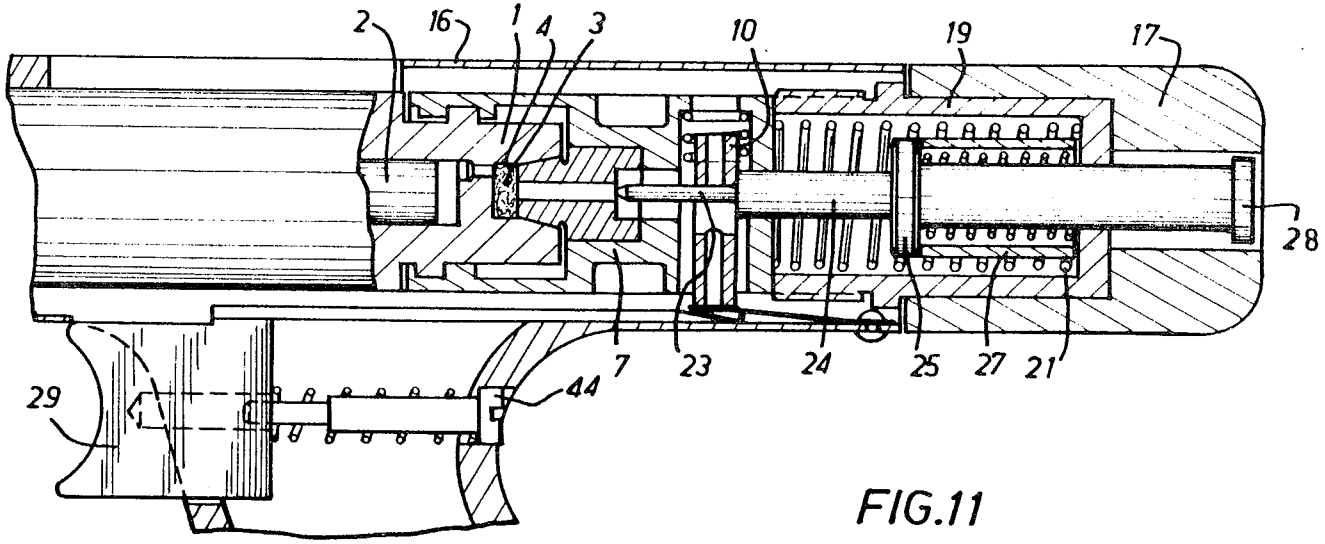
FIG. 11 is similar to FIG. 1 in respect of a modification.
Figure 12:
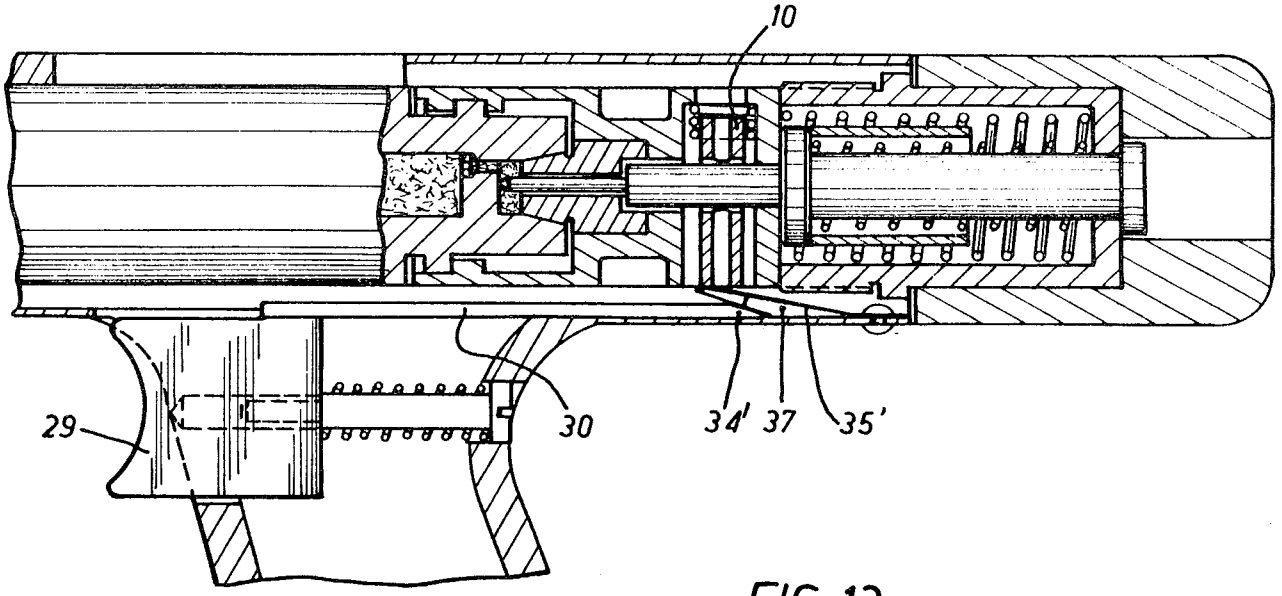
FIG. 12 represents the gun shown in FIG. 11 in the position corresponding to FIG. 5.
Figure 13:
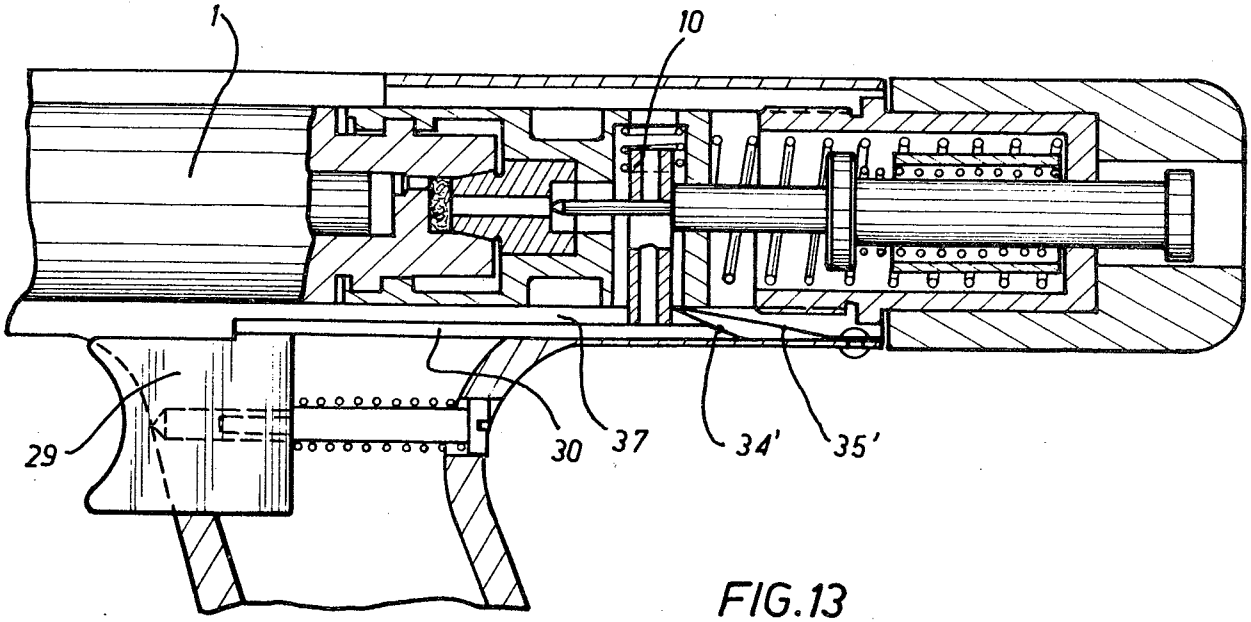
FIG. 13 is a view of the gun shown in FIGS. 11 and 12 in the position corresponding to FIG. 10.

Reference will now be made to FIGS. 11, 12 and 13 which show a modification of the gun according to the invention. Like reference numerals designate like parts.

In this modification, in order to avoid the slight tilting of the trigger 29 in the course of the rearward movement, the bevel 34' of the rod 30 is inverted and engaged under the ramp 35' which is movable for this purpose and disposed under the locking member 10 which it actuates directly (FIG. 12).

Further, in this modification, safety is afforded in the case where the operator might prematurely depress the trigger before the barrel 1 has been completely urged against the wall (FIG. 13). In this case, the movable ramp 35' projects into the groove 37 and abuts the end of the locking member 10 which locks the barrel-breech assembly 1 against movement and precludes any possibility of firing.

What I claim is:

1. A fastening gun of the type in which a striker causes the ignition of a charge, said gun including means for holding a charge, a striker assembly moveable between a fired position and a cocked position, means urging said firing pin toward its fired position, a locking member including a bore and moveable in a direction transverse to the direction of movement of said striker assembly between a locking and an unlocking position, said striker assembly being slidable in said bore, means on said striker assembly for engaging said locking member when said locking member is in said locking position, means for biasing said locking member into its locked position, a trigger member mounted remote from said locking member, an elongated rod member attached to and extending from said trigger member toward said locking member, and fixed ramp means mounted in said gun and including an inclined surface for cooperating with the free end of said elongated rod member to raise said free end to engage said locking member and move it from its locking position to its unlocking position upon actuation of the trigger member.

2. The fastening gun of claim 1, wherein said means for holding a charge includes means for holding a charge of the caseless type, at least one groove in said gun, said elongated rod member being slidable in said groove, and means for permitting a part of the gases of combustion to bleed downstream of said striker assembly and into said groove.

3. A fastening gun of the type in which a striker causes the ignition of a charge, said gun including means for holding a charge, a striker assembly moveable between a fired position and a cocked position, means urging said firing pin toward its fired position, a locking member including a bore and moveable in a direction transverse to the direction of movement of said striker assembly between a locking and an unlocking position, said striker assembly being slidable in said bore, means on said striker assembly for engaging said locking member when said locking member is in said locking position, means for biasing said locking member into its locked position, a trigger member mounted remote from said locking member, an elongated rod member attached to and extending from said trigger member toward said locking member, and moveable ramp means mounted in said gun and including an inclined surface for cooperating with the free end of said elongated rod member to raise said ramp means to engage said locking member and move it from its locking position to its unlocking position upon actuation of the trigger member.

4. The fastening gun of claim 3, wherein said means for holding a charge includes means for holding a charge of the caseless type, at least one groove in said gun, said elongated rod member being slidable in said groove, and means for permitting a part of the gases of combustion to bleed downstream of said striker assembly and into said groove.

* * * * *

UNITED STATES PATENT AND TRADEMARK OFFICE

CERTIFICATE OF CORRECTION

PATENT NO. : 3,949,921

DATED : April 13, 1976

INVENTOR(S) : Jacques Brack

It is certified that error appears in the above–identified patent and that said Letters Patent are hereby corrected as shown below:

[30] Foreign Priority Data

Switzerland No. 11 523/73 filed August 9, 1973

Signed and Sealed this

*twenty-ninth* Day of *June 1976*

[SEAL]

*Attest:*

RUTH C. MASON
*Attesting Officer*

C. MARSHALL DANN
*Commissioner of Patents and Trademarks*